United States Patent [19]

Nyswander et al.

[11] 4,092,621

[45] May 30, 1978

[54] THIN FOIL PULSE TRANSFORMER COIL FOR REDUCING DISTRIBUTED AND LEAKAGE INDUCTANCE

[75] Inventors: Reuben E. Nyswander, China Lake; Paul E. Stewart, Ridgecrest, both of Calif.

[73] Assignee: The United States of America as represented by the Secretary of the Navy, Washington, D.C.

[21] Appl. No.: 743,428

[22] Filed: Nov. 18, 1976

[51] Int. Cl.[2] ..... H01F 27/28

[52] U.S. Cl. ..... 336/184; 29/605; 336/192; 336/223

[58] Field of Search ..... 336/192, 232, 233, 181, 336/180, 184, 223; 29/602, 604, 605

[56] References Cited

U.S. PATENT DOCUMENTS

| | | | |
|---|---|---|---|
| 2,963,669 | 12/1960 | Salisbury | 336/223 X |
| 3,074,037 | 1/1963 | Stein | 336/223 X |
| 3,163,840 | 12/1964 | Zack | 336/223 X |
| 3,263,197 | 7/1966 | Lewis | 336/223 X |
| 3,353,132 | 11/1967 | D'Entremont | 336/181 X |
| 3,386,060 | 5/1968 | Reber | 336/184 X |
| 3,474,370 | 10/1969 | Lightner | 336/192 |
| 3,826,967 | 7/1974 | Wilkinson et al. | 336/232 X |

*Primary Examiner*—Thomas J. Kozma

*Attorney, Agent, or Firm*—R. S. Sciascia; Roy Miller; W. T. Skeer

[57] ABSTRACT

A method of winding pulse transformers with copper tape or foil and bringing out the leads directly from the winding on strip transmission line. This technique minimizes distributed inductance and leakage inductance of the leads connecting the transformer to external circuitry. It is particularly useful in high step-up ratio pulse transformers and/or pulse transformers in which the output pulse must have a very short rise time and fall time.

3 Claims, 3 Drawing Figures

THIN FOIL PULSE TRANSFORMER COIL FOR REDUCING DISTRIBUTED AND LEAKAGE INDUCTANCE

BACKGROUND OF THE INVENTION

Pulse transformers are those designed to handle nearly rectangular wave forms. A common and important application is the coupling of a load resistance to a source of pulsed power. Radar transmitters, for instance, usually employ an output power tube such as a magnetron, which must be driven at a relatively high voltage and high impedance level. The pulse modulator, however, generates pulses at relatively low levels of voltage and impendance. The output impedance of the modulator is limited to a region defined by the maximum voltage and peak current ratings of the pulse switch which is used. It is customary to couple the modulator to the load with the necessary impedance transformation by using a pulse transformer having the appropriate step-up ratio.

If $Z_o$ is the optimum output impedance of the modulator and $R_{LOAD}$ is the static load resistance of the power tube (usually a magnetron) at its operating point, then the required step-up ratio of the pulse transformer, $r$, is given by $$r = \left(\frac{R_{LOAD}}{z_o}\right)^{\frac{1}{2}} \quad (1)$$

For a given pulse duration, $\delta$, the total inductance, L, in the modulator pulse-forming circuit is $$L = \frac{.5R_{LOAD}\,\delta}{r^2} \quad (2)$$

The quantity, L, includes the distributed inductance of the leads and the total leakage inductance of the pulse transformer referred to the primary.

From Eq. 2 it can be seen that L is proportional to the quantity $\delta/r^2$. Where $\delta/r^2$ is small, as for short pulses and/or large step-up ratios, then L becomes small also. It then becomes a problem to design a pulse transformer whose distributed inductance plus leakage inductance is smaller than the required value of L.

It is known to make inductive windings for transformers from metallic foils, sheet or strip as well as wire. Since turn to turn voltages are relatively low, insulation is provided by a thin strip of material, such as kraft paper wound between the conductor turns at the time the winding is constructed. A coating of insulating enamel has also been used.

To minimize eddy current losses in sheet wound transformers, it is common to subdivide the conducting sheet into two or more elements connected in parallel at the beginning and end of the windings. In sheet type windings this is done by winding a number of sheet conductors simultaneously in a superposed relation. The parallel loops, however, introduce losses due to circulating currents. These losses are minimized by transposing the loops at various points on the winding. In the case of sheet conductors, this presents a difficult manufacturing problem, requiring intricate notching and arrangement of the sheets. Another drawback of this technique is increased heating due to the smaller conducting area.

This problem does not exist in the pulse transformers for which this invention is applicable since the average current requirements are relatively low. Typically, the winding may be wound of copper sheet 1–2 mils thick. Eddy current losses in the sheet are proportional to the square of its thickness and are extremely small for 1 mil material. Therefore, it is not necessary nor desirable to use a plurality of parallel sheets insulated from each other and connected together at the ends of the winding.

A sheet wound transformer also develops eddy currents and distributed inductance in nearby conductors such as the lead-in conductors. These currents are sometimes reduced by pairing lead-in conductors in opposite directions of conductance. It has generally been thought necessary to employ the subdivided winding arrangement described above in order to get the lead-in conductors to share the current equally.

When a subdivided winding with multiple lead-in conductors is employed, the method of connecting lead-in conductors to the conductor windings is more complex than the standard method whereby a single lead-in conductor is attached at opposite ends of both (or all) of the parallel windings. A standard lead-in conductor is a thin metal strip such as copper attached as by soldering to the parallel conductors so as to extend along their width.

Stripline transmission material consists of two conductors separated along their length by a dielectric material which allows the conductors to interact. It has been used to form the parallel windings of a transformer, as in U.S. Pat. No. 3,611,233. It has not, however, to the inventors's knowledge, been previously used for coupling lead-in connections nor has it been effectively employed to couple lead-ins to a single foil winding to reduce distributed inductance.

SUMMARY OF THE INVENTION

A coil for a pulse transformer is wound from a single sheet of copper tape or foil. Distributed inductance and leakage inductance are minimized by lead-in conductors attached first to the entire width of the inner end of the wound sheet and then to the entire width of the outer end of the wound sheet, being juxtaposed and brought out past the winding where dielectric is sandwiched between the leads to form a stripline. A thin sheet of insulating dielectric is wound on with the tape to provide interwinding insulation. When using a C-core, copper tape windings may be placed on each leg and wound in opposite directions to further reduce stray inductance.

The coil of the present invention is easy to manufacture in that the first lead extends along the foil for the length of the bobbin. The foil and insulation may be readily simultaneously rolled on and the finishing lead attached to the outer turn of foil.

DESCRIPTION OF THE PREFERRED EMBODIMENT

Figure 1:
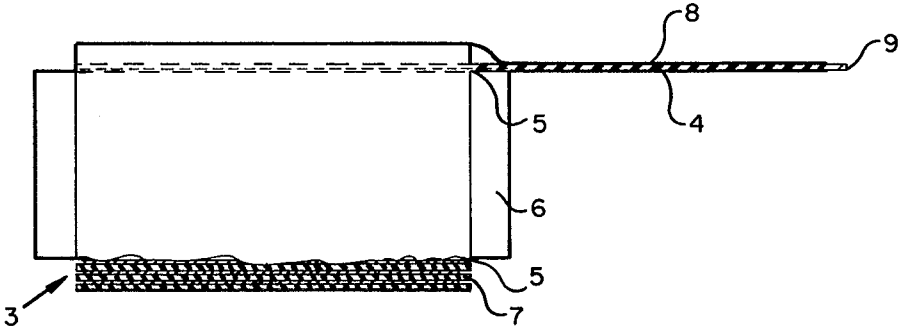
FIG. 1 shows a side view in partial section of a coil and lead-ins of the present invention.

In winding a pulse transformer of the present invention with copper tape, a tape is used whose width is enough less than the window width of the core to permit adequate insulation between the core and the edges of the tape. Referring now to FIG. 1, before the winding 3 is started, the lead 4 is attached to the tape 5, preferably by soldering. The lead 4 is a length of copper strip which is nearly as wide as the top surface of the bobbin 6. A conventional square bobbin is shown, but of course other shapes could be used. The inner lead 4 and the outer lead 8 are conductive strips of sufficient width to cover a substantial portion of one side of a square bobbin, or one fourth the circumference of the bobbin.

The start of the winding 3 is affixed to the bobbin 6, using epoxy or pressure sensitive adhesive tape. Also, copper tape is available with a pressure sensitive adhesive backing which can be used to hold it to the bobbin 6.

Figure 2:
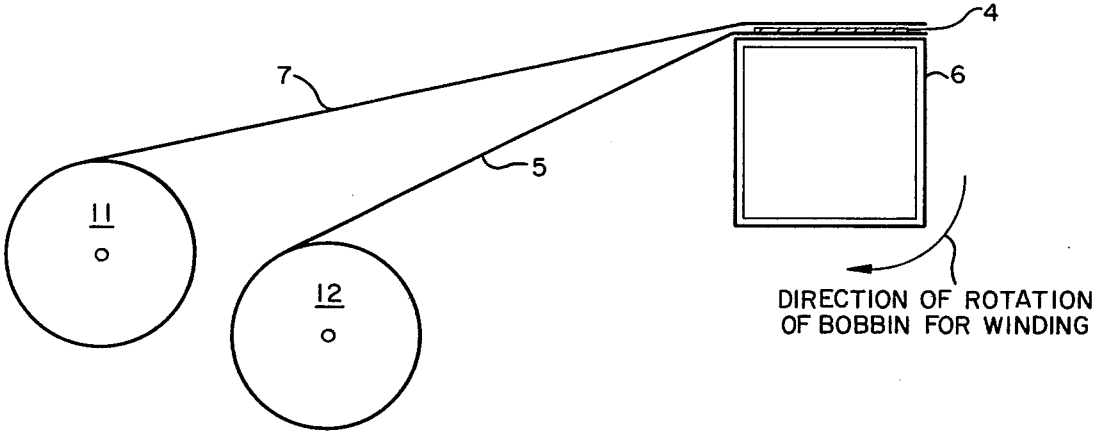
FIG. 2 is an end view of the foil and insulation of the present invention as it is being wound onto the bobbin.

The intra-winding insulation 7 consists of a layer of dielectric which is wound on with the copper tape 5 as shown in FIG. 2. The end of the dielectric is affixed to the bobbin 6 over the copper tape 5 and lead 4 with enough overlap for good insulation. The dielectric insulation 7 should be sufficiently wide so that its edges project beyond the edges of the copper tape 5 far enough to prevent voltage breakdown between the turns.

The necessary number of turns of tape and insulation are wound from spools 11 and 12 onto the bobbin 6 and cut off such that the end of the copper tape is directly opposite and adjacent to the copper strip lead 4 on the inside of the winding. The lead 8 to the outside end of the winding is now soldered on in exactly the same manner as the lead 4 was soldered to the inside end. The lead 8 is also of similar width. Due to this fabrication technique, the copper strip leads 4 and 8 are parallel, one on top of the other, with flat sides together. Insulation 9 thick enough to withstand the voltage across the winding is sandwiched between the leads. While thick enough to withstand the dc voltage, the configuration and placement is such as to permit effective coupling therebetween as to minimize distributed inductance. This arrangement results in an improved high frequency transformer coupling.

With step-up pulse transformers it is usually of advantage to wind only the primary with copper tape. Distributed inductance and leakage inductance in the secondary circuit, when referred back to the primary, are reduced by the square of the turns ratio. Thus, they comprise a negligible portion of the quantity, L, in Eq. 2. Therefore, in general, the secondary can be wire-wound.

Figure 3:
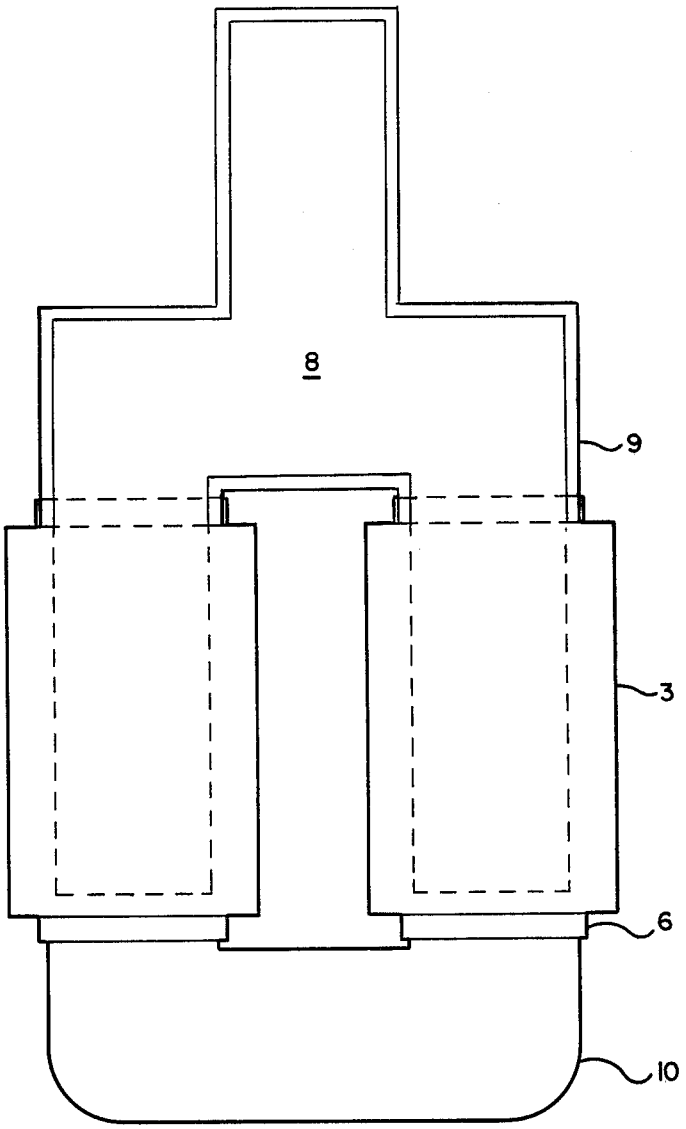
FIG. 3 is a plan view of the present invention as used in a C-core.

Referring now to FIG. 3, the quantity L can be further reduced by placing a copper tape primary winding on each leg of a typical C-core 10 (bottom half shown). The two windings are wound in opposite directions and are connected in parallel.

The wire-wound secondaries are not shown, but can be wound and inter-connected in any of the conventional configurations.

A single, branched strip is used for each lead. Insulation 9 extends beyond the width of the leads 8 and 4 (not shown) as well as being between the leads as previously discussed.

Thus, there has been described a type of winding which, when incorporated with its connections into a step-up transformer, especially a pulse transformer, reduces stray inductance. By using thin foil windings (on the order of 2 mils) there is no need for multiple windings to reduce eddy currents. By sandwiching wide leads along the length of the winding and beyond the winding to form a stripline, distributed and leakage inductance are minimized.

Changes in the materials and form of the preferred embodiment can be envisioned as well as variations of the described method of manufacture. However, the scope of the invention should be considered to be limited only by the appended claims.

What is claimed is:

1. A transformer coil for a high-frequency pulse transformer comprising;
   - a bobbin having four sides and a hollow center for placement about a core;
   - a thin sheet of foil attached along its width to said bobbin and wound lengthwise about the bobbin in a coil;
   - a first metal strip lead-in conductor having a width substantially covering one side of said bobbin and attached to said foil along the entire width of said foil on the inner end of said coil adjacent to said bobbin, said first metal strip extending lengthwise in a single direction beyond said coil adjacent to one side of said bobbin;
   - a sheet of insulating material disposed between turns of said coil and extending beyond the edges thereof so as to provide insulation between turns;
   - a second lead-in conductor attached to said foil along the entire width of said foil on the outer end of said coil and extending lengthwise beyond said coil in a single axial direction so as to form a region where said first lead-in and said second lead-in extend beyond the coil and are parallel and extending in width across a substantial portion of one side of the bobbin; and
   - a layer of dielectric material sandwiched in said region between said first lead-in connector and said second lead-in connector so as to form a stripline connector to said coil and extending axially from one end thereof to facilitate assembly of said coil in a pulse transformer.

2. The transformer coil of claim 1 wherein said layer of dielectric material is of a width in excess of the first lead-in and the second lead-in and extends beyond the laterial edges thereof.

3. The transformer coil of claim 2 wherein said first lead-in and second lead-in are bifurcated and, in addition to being connected to said coil, are connected in the same manner to another coil, the bifurcation serving to position each coil so as to facilitate a leg of a single C-core to be inserted through the hollow center of each bobbin.

* * * * *